US006132066A

United States Patent [19]

Freedman et al.

[11] Patent Number: 6,132,066

[45] Date of Patent: Oct. 17, 2000

[54] OPTICAL UNIT FOR AISLE LIGHTING

[75] Inventors: Joshua M. Freedman, Boulder, Colo.; Herbert A. Fouke, Newark; Gregory J. Subisak, Gahanna, both of Ohio

[73] Assignee: Holophane Corporation, Newark, Ohio

[21] Appl. No.: 09/241,562

[22] Filed: Feb. 1, 1999

[51] Int. Cl.[7] ..... F21V 7/00

[52] U.S. Cl. ..... 362/297; 362/308; 362/348; 362/350

[58] Field of Search ..... 362/297, 308, 362/327, 340, 334, 346, 347, 348, 350

[56] References Cited

U.S. PATENT DOCUMENTS

| | | | |
|---|---|---|---|
| 3,581,082 | 5/1971 | Shadwick | 240/106 |
| 3,800,138 | 3/1974 | Shadwick | 240/106 |
| 4,858,091 | 8/1989 | Fouke . | |
| 5,335,157 | 8/1994 | Lyons | 362/297 |
| 5,434,765 | 7/1995 | Kelly et al. | 362/274 |
| 5,913,599 | 6/1999 | Smith et al. | 362/328 |

*Primary Examiner*—Sandra O'Shea
*Assistant Examiner*—John Anthony Ward

[57] ABSTRACT

An optical unit is provided for use in a suspended aisle luminaire. The optical unit comprises a plurality of metalized reflecting components which are operative to produce a uniform illuminance level along vertical surfaces of an aisle while minimizing glare toward workers in the aisle. Secondly, the optical unit includes a plurality of non-metalized reflecting components which are operative to illuminate the vertical and horizontal surfaces of the aisle. Additionally, the optical unit may further comprise a plurality of refracting components which are operative to illuminate vertical surfaces near the luminaire and reduce dark spots on the vertical surfaces.

9 Claims, 5 Drawing Sheets

OPTICAL UNIT FOR AISLE LIGHTING

TECHNICAL FIELD

This invention relates generally to electric lighting fixtures and, more particularly, to an improved optical unit for use in a suspended luminaire to illuminate aisles.

BACKGROUND ART

It is desirable to provide useful and efficient lighting to illuminate aisles both at the retail display level and warehouse storage facilities. Typically, such aisles are lighted by suspended luminaires having optical units comprised of plastic or glass. These optical units may include one or more refracting components such as refracting prisms and, in some cases, may also include a reflector. See, for example, the improved luminaire with up-light control disclosed in U.S. Pat. No. 4,858,091 which is assigned of record to Applicants' assignee, Holophane Corporation.

The above-mentioned suspended luminaires have been found in practice to be unsuitable for illuminating aisles because the vertical surfaces of the aisles are not provided with uniform lighting. More specifically, it has been found that undesirable dark spots are created on the aisles. The fixtures have also been found to produce undesirable glare to workers in the aisle.

Consequently, a need has developed for an improved optical unit for use in suspended aisle luminaires which will provide uniform lighting of the vertical surfaces of the corresponding aisles. Such an optical unit should produce light which is comfortable to view by workers or customers in the aisle and thus be devoid of undesirable glare.

DISCLOSURE OF THE INVENTION

It is a principle object of the present invention to provide an improved optical unit for use in suspended aisle luminaires which provides uniform lighting on the vertical surfaces of an aisle and eliminates undesirable glare to workers and customers in the aisle.

In carrying out the above object and other objects, features, and advantages of the invention, there is provided an optical unit which includes a plurality of metalized reflecting components and a plurality of non-metalized reflecting components. Preferably, a plurality of refracting components is additionally included in the optical unit. In a preferred embodiment, the optical unit is comprised of glass, and all reflecting and refracting components comprise prisms.

In a preferred embodiment disclosed herein, the optical unit includes a substantially dome-shaped housing which defines a substantially circular light opening having a 360° periphery. Symmetric first and second portions of the housing each include a plurality of metalized reflecting prisms. Symmetric third and fourth portions of the housing each further include-non-metalized reflecting prisms and refracting prisms. In keeping with the invention, the metalized reflecting prisms are operative to produce a uniform illuminance level along the vertical surfaces of the aisle while at the same time minimizing glare toward workers in the aisle. Still further, the non-metalized reflecting prisms are operative to illuminate the vertical and horizontal surfaces of the aisle. Finally, the refracting prisms are operative to illuminate vertical surfaces near the luminaire and to reduce dark spots.

BEST MODES FOR CARRYING OUT THE INVENTION

Figure 1:
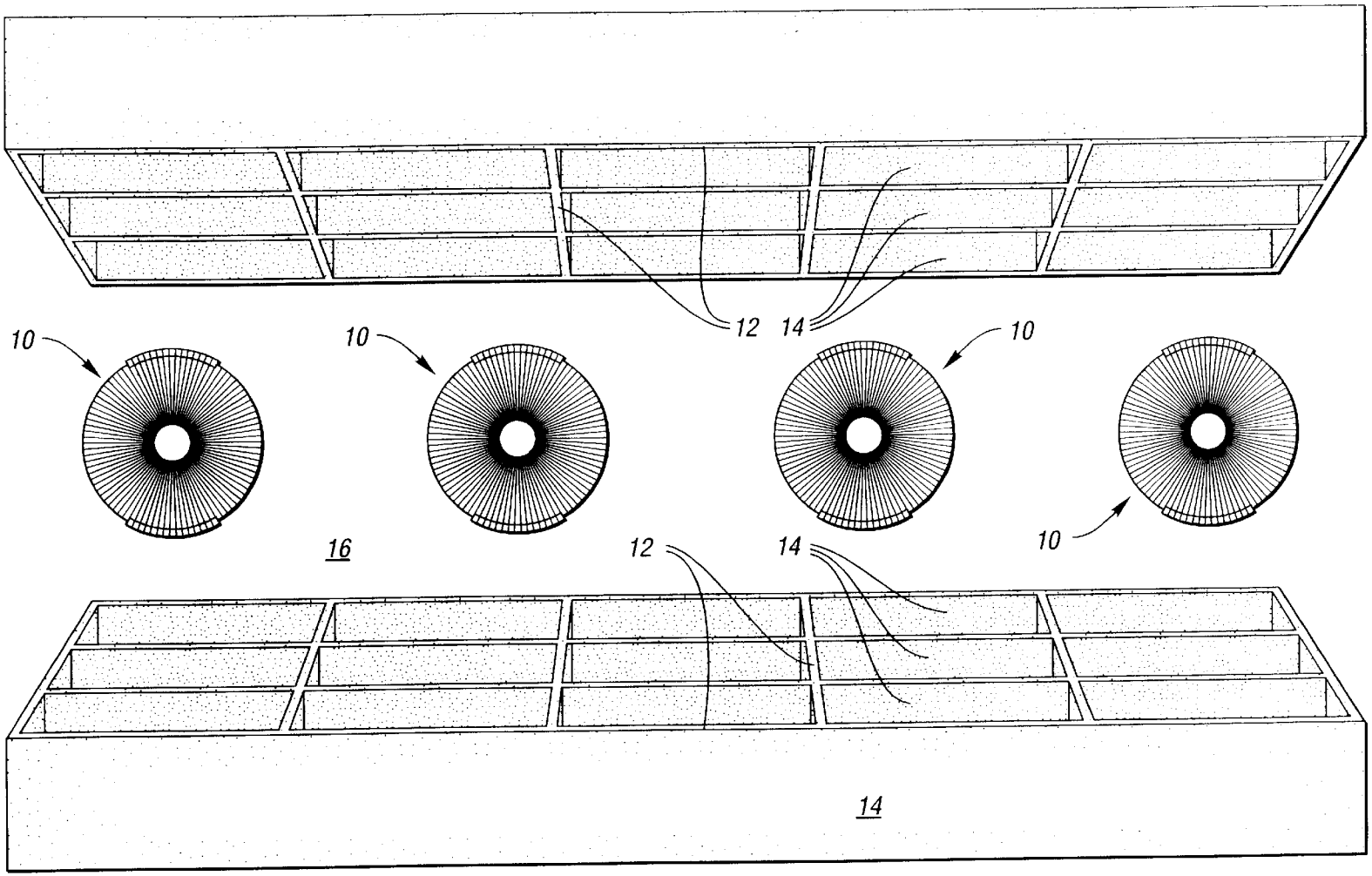
FIG. 1 is a top, perspective view of a plurality of optical units in accordance with the present invention shown positioned within an aisle.

With reference to FIG. 1, there is shown a generalized arrangement of optical units for use in suspended luminaires in accordance with the present invention. The optical units, which are designated generally by reference numeral 10, are typically affixed to ballast assemblies (not shown) and are primarily intended for use in illuminating the vertical surfaces 12, as well as horizontal surfaces 14, of an aisle 16. Such aisles may comprise, for example, point of sale displays, warehouse or manufacturing storage aisles, or virtually any aisle arrangement where merchandise is placed.

Figure 2:
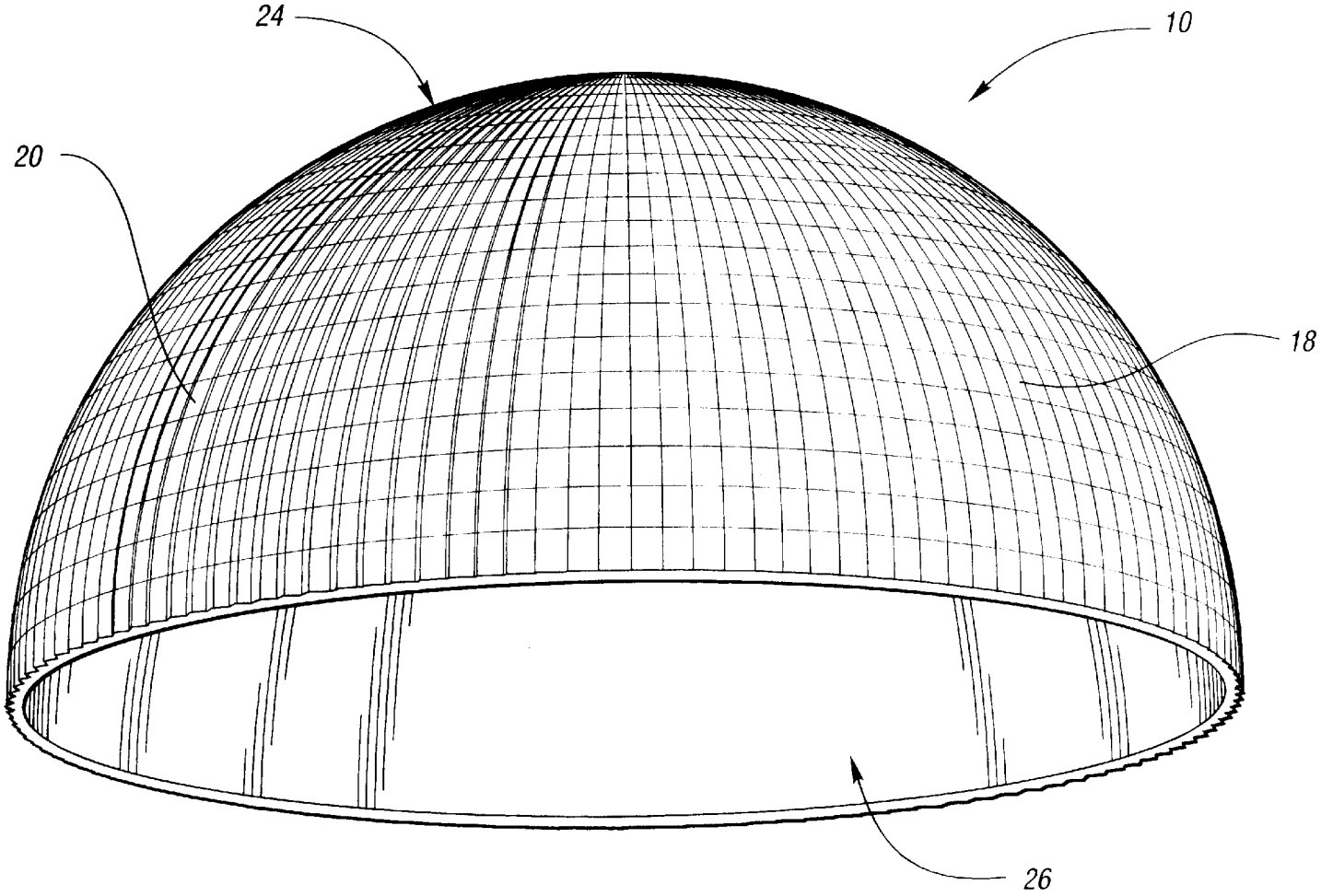
FIG. 2 is a perspective view of a two-component optical unit in accordance with the present invention.

Referring now to FIG. 2, there is shown a perspective view of an optical unit 10 made in accordance with the teachings of the present invention. As shown, optical unit 10 includes a combination of metalized reflecting components 18, such as prisms, which may be placed on glass. Alternatively, silver may be vacuum-deposited on plastic, or another suitable housing material may be used. The purpose of metalized reflecting components 18 is to produce a uniform illuminance level along vertical surfaces 12 of aisle 16 (FIG. 1) while at the same time minimizing glare toward workers in aisle 16. Optical unit 10 further includes non-metalized reflecting components 20, such as 45° reflecting prisms. The purpose of non-metalized reflecting components 20 is to illuminate the vertical 12 and horizontal 14 surfaces of aisle 16 (FIG. 1), thereby controlling down light.

Figure 3:
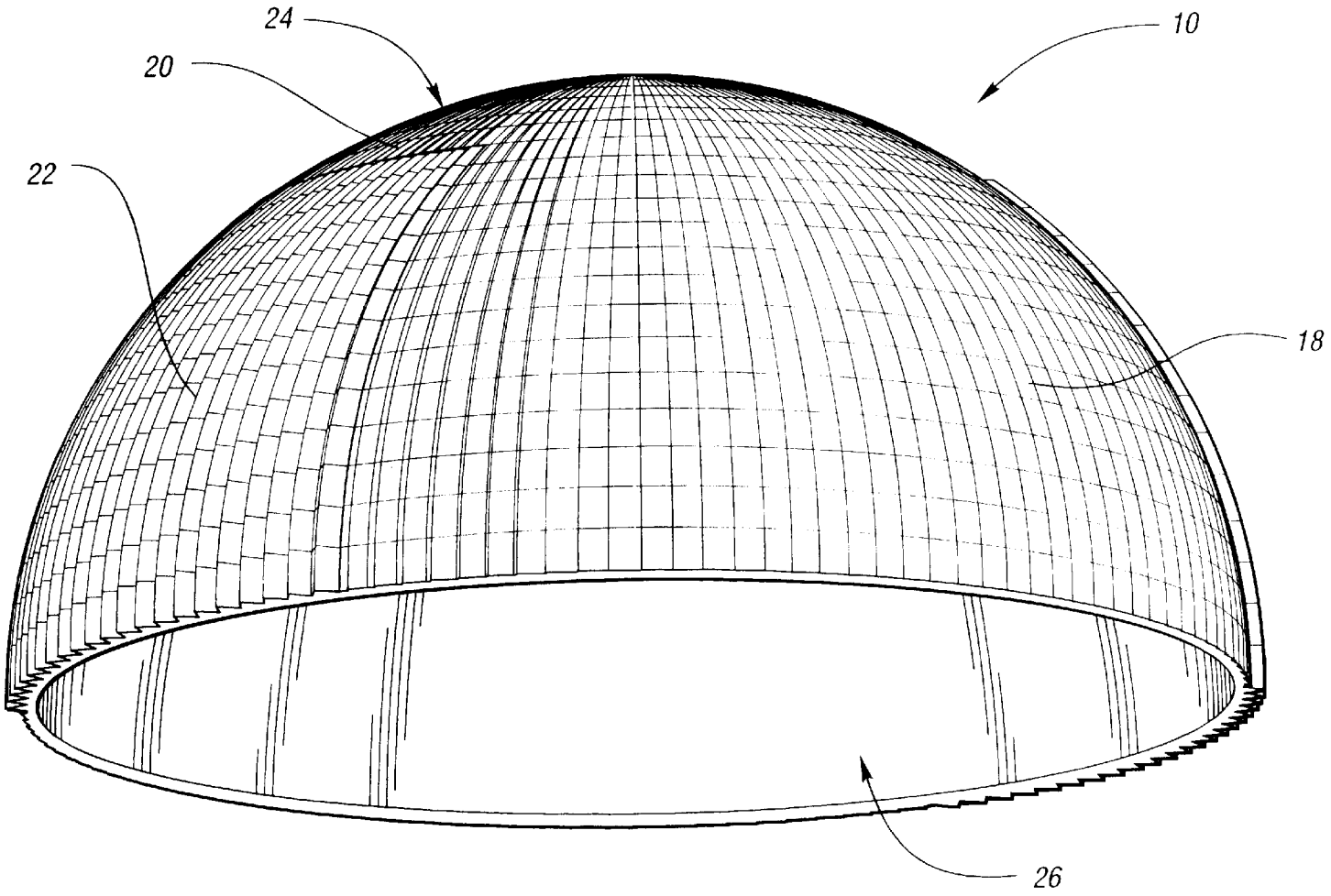
FIG. 3 is a perspective view of a preferred, three-component embodiment of the optical unit of the present invention.

Preferably, optical unit 10 additionally includes a plurality of refracting components 22, such as prisms, as shown in FIG. 3. The purpose of refracting components 22 is to illuminate the areas between optical units 10 so as to reduce, if not eliminate, dark spots on the vertical surfaces 12 of aisle 16, thereby controlling up light. It is the combination of the three component structures shown in FIG. 3 which produces the preferred light distribution on the vertical surfaces 12 of aisle 16, as well as between optical units 10.

As shown in FIGS. 2 and 3, optical unit 10 preferably comprises a substantially dome-shaped housing 24 so as to define a substantially circular light opening 26 having a 360° periphery. Depending on the desired application, a combination of metalized reflecting components 18, non-metalized reflecting components 20, and refracting components 22 may be placed at virtually any location and in any proportion on housing 24.

Figure 4:
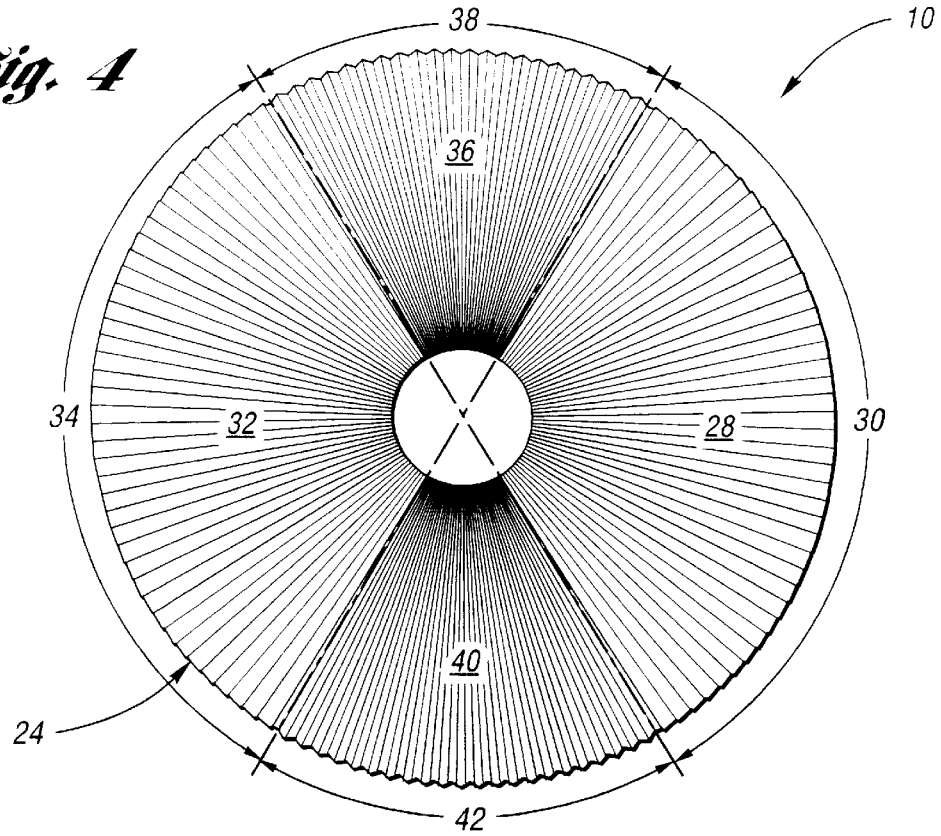
FIG. 4 is a top view of the two-component optical unit of FIG. 2 illustrating the distribution of metalized reflecting components and non-metalized reflecting components.

In the two-component embodiment of optical unit 10 illustrated in FIG. 4, a first plurality 28 of metalized reflecting components 18 is disposed on a first portion 30 of housing 24. A second plurality 32 of metalized reflecting components 18 is disposed on a second portion 34 of housing 24 symmetric to first portion 30. Preferably, first 30 and second 34 portions of housing 24 and the first 28 and second 32 pluralities of metalized reflecting components 18 contained thereon extend approximately 120° about the periphery of light opening 26. Of course, various other orientations will be acceptable and thus within the spirit of the invention depending on the desired application. The ranges given are for exemplary purposes only.

Still referring to FIG. 4, a first plurality 36 of non-metalized reflecting components 20 is disposed on a third portion 38 of housing 24. A second plurality 40 of non-metalized reflecting components 20 is further disposed on a fourth portion 42 of housing 24 symmetric to third portion 38. Preferably, third 38 and fourth 42 portions of housing 24 and the first 36 and second 40 pluralities of non-metalized reflecting components 20 contained thereon extend approximately 60° about the periphery of light opening 26.

Figure 5:
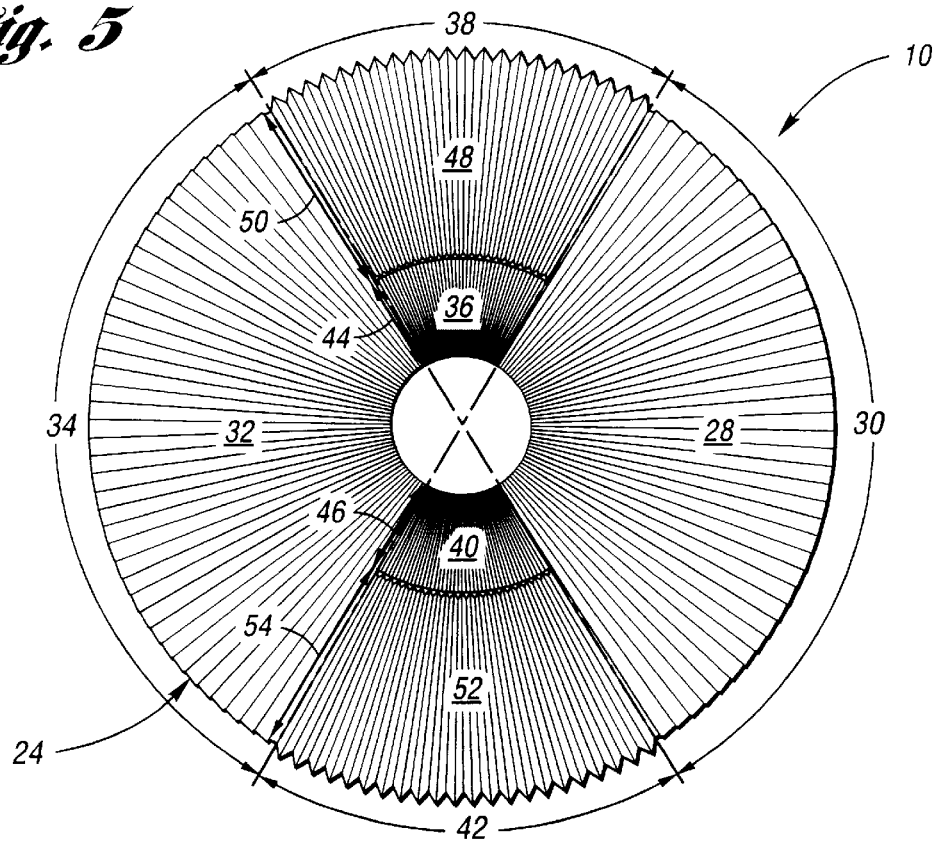
FIG. 5 is a top view of the preferred, three-component optical unit of FIG. 3 illustrating the distribution of metalized reflecting components, non-metalized reflecting components, and refracting components.

Referring now to FIG. 5, the preferred three-component embodiment of optical unit 10 is depicted. As shown, first 28 and second 32 pluralities of metalized reflecting components 18 are disposed on first 30 and second 34 portions of housing 24 in a manner identical to that depicted in FIG. 4. However, third 38 and fourth 42 portions of housing 24 are now divided into sections so that refracting components 22, in addition to non-metalized reflecting components 20, may be accommodated.

In the preferred embodiment of FIG. 5, first plurality 36 of non-metalized reflecting components 20 is disposed on a first section 44 of third portion 38, and second plurality 40 of non-metalized reflecting components 20 is disposed on a first section 46 of fourth portion 42. In addition, a first plurality 48 of refracting components 22 is disposed on a second section 50 of third portion 38, and a second plurality 52 of refracting components 22 is disposed on a second section 54 of fourth portion 42 of housing 24. First 48 and second 52 pluralities of refracting components 22 are preferably positioned to face the vertical surfaces 12 of aisle 16 (FIG. 1).

Figure 6:
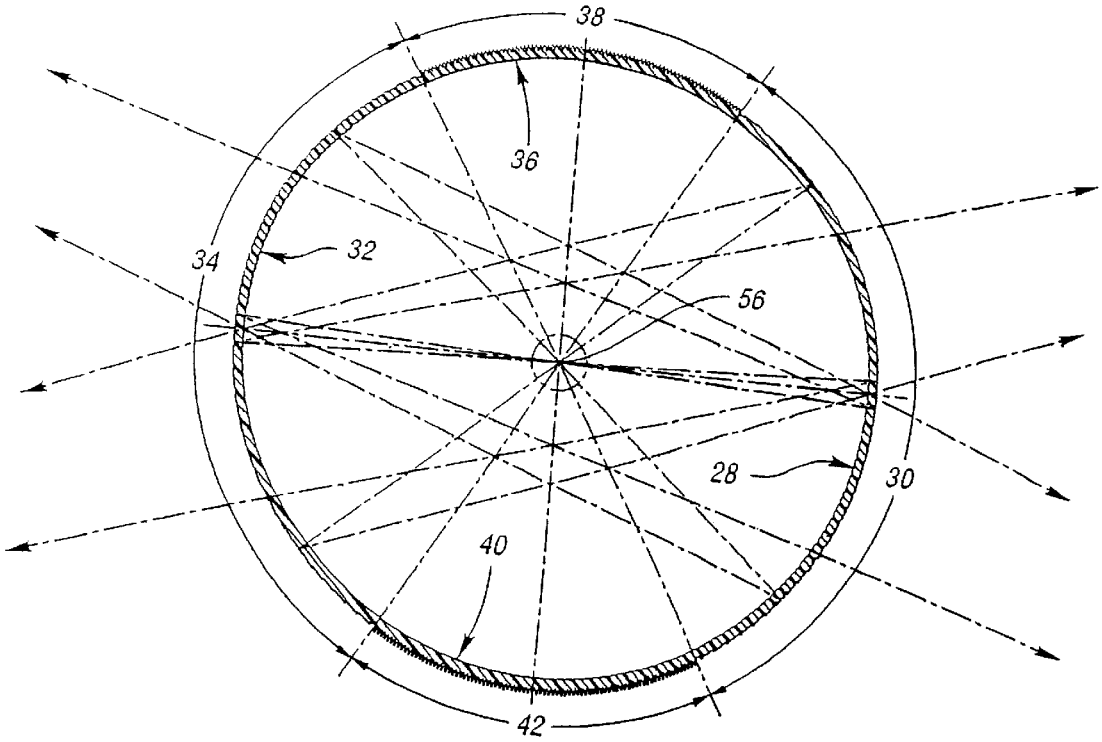
FIG. 6 is a cross-sectional view of the optical unit of FIG. 3 illustrating the operation of the metalized reflecting components.
Figure 7:
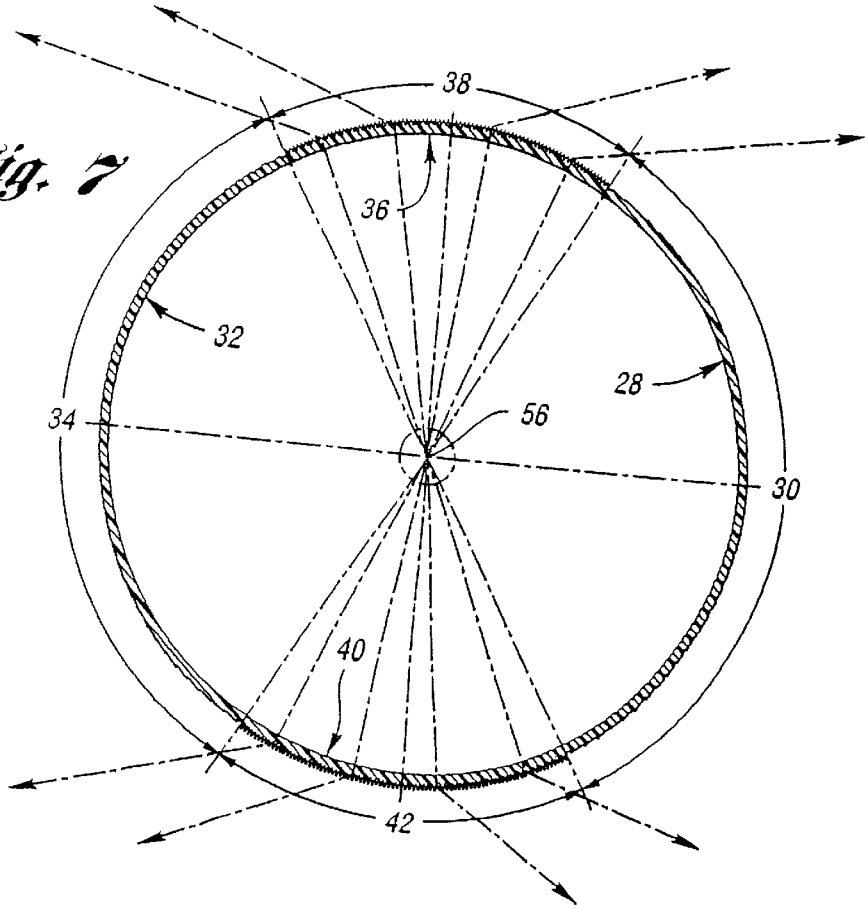
FIG. 7 is a cross-sectional view of the optical unit of FIG. 3 illustrating the operation of the refracting components

FIGS. 6 and 7 illustrate the manner in which metalized reflecting components 18 and refracting components 22, respectively, operate to direct light from a light source 56 contained within optical unit 10.

While the best modes for carrying out the invention have been described in detail, those familiar with the art to which this invention relates will recognize various alternative designs and embodiments for practicing the invention as defined by the following claims.

What is claimed is:

1. An optical unit for use in a suspended luminaire, the unit comprising:

a housing;

a first plurality of metalized reflecting components disposed on a first portion of the housing;

a second plurality of metalized reflecting components disposed on a second portion of the housing;

a first plurality of non-metalized reflecting components disposed on a third portion of the housing; and a second plurality of non-metalized reflecting components disposed on a fourth portion of the housing.

2. An optical unit as in claim 1, wherein the housing is glass.

3. An optical unit as in claim 1, wherein the reflecting components are prisms.

4. An optical unit as in claim 1, wherein the housing is substantially dome-shaped and defines a substantially circular light opening having a 360° periphery.

5. An optical unit as in claim 1, wherein the first and second portions of the housing each extend approximately 120° about the periphery of the light opening.

6. An optical unit as in claim 1, wherein the third and fourth portions of the housing each extend approximately 60° about the periphery of the light opening.

7. An optical unit as in claim 1, wherein the housing is comprised of plastic and the reflecting prisms are vacuum deposited silver.

8. An optical unit as in claim 1, wherein the non-metalized reflecting prisms are 45° prisms.

9. An optical unit for use in a suspended aisle luminaire, the optical unit comprising:

a substantially dome-shaped housing defining a substantially circular light opening having a 360° periphery;

a first plurality of metalized reflecting components disposed on a first portion of the housing;

a second plurality of metalized reflecting components disposed on a second portion of the housing symmetric to the first portion, the metalized reflecting components operative to produce a uniform illuminance level along vertical surfaces of an aisle while minimizing glare toward workers in the aisle;

a first plurality of non-metalized reflecting components disposed on a first section of a third portion of the housing;

a second plurality of non-metalized reflecting components disposed on a second section of a fourth portion of the housing symmetric to the third portion, the non-metalized reflecting components operative to illuminate the vertical and horizontal surfaces of the aisle;

a first plurality of refracting components disposed on a second section of the third portion of the housing; and a second plurality of refracting components disposed on a second section of the fourth portion of the housing, the refracting components operative to illuminate vertical surfaces near the luminaire and reduce dark spots.

* * * * *